US005356132A

United States Patent [19]

McEwan et al.

[11] Patent Number: 5,356,132

[45] Date of Patent: Oct. 18, 1994

[54] VERSATILE PLAYGROUND AND FLOTATION DEVICE

[76] Inventors: Charles McEwan; Barbara J. McEwan, both of 11080 Arroyo Beach Pl., SW., Seattle, Wash. 98146

[21] Appl. No.: 78,960

[22] Filed: Jun. 17, 1993

Related U.S. Application Data

[63] Continuation of Ser. No. 747,600, Aug. 21, 1991, abandoned.

[51] Int. Cl.[5] ..... A63B 65/10; A63B 67/06

[52] U.S. Cl. ..... 273/26 R; 273/55 R; 273/56; 273/195 R; 273/336; 273/425; 273/DIG. 8

[58] Field of Search ..... 273/26 R, 55 R, 195 R, 273/212, 411, 425, 336, 337, 338, 339, 56, 57, DIG. 8

[56] References Cited

U.S. PATENT DOCUMENTS

| | | | |
|---|---|---|---|
| 1,926,920 | 9/1933 | Smith | 273/336 X |
| 2,994,327 | 8/1961 | Otto et al. | 132/245 |
| 3,371,647 | 3/1968 | Shopbell | 116/209 |
| 3,421,762 | 1/1969 | Paradise | 273/339 |
| 3,865,375 | 2/1975 | Cosgrove | 273/411 X |
| 3,921,978 | 11/1975 | Warren | 273/67 R |
| 4,079,936 | 3/1978 | Schacter | 273/67 R |
| 4,149,723 | 4/1979 | Simon | 273/411 |
| 4,227,961 | 10/1980 | Lefebre et al. | 273/26 R |
| 4,265,276 | 5/1981 | Hatada | 604/280 X |
| 4,380,885 | 4/1983 | Komagata | 273/425 X |
| 4,690,404 | 9/1987 | Yoder | 273/67 R |
| 4,850,596 | 7/1989 | Oluno | 273/DIG. 8 X |
| 4,936,804 | 6/1990 | Dowdeswell | 441/6 |
| 4,938,478 | 7/1990 | Lay | 273/26 R |

OTHER PUBLICATIONS

*Poplular Science* "How To Make a Batting Tee" March 1959 p. 183.

*Primary Examiner*—William H. Grieb

*Attorney, Agent, or Firm*—David L. Garrison; Stephen M. Evans

[57] ABSTRACT

A playfield, aquatic flotation and sports amusement device formed from an elongated cylinder of foam material which has axial recess means to receive elongated cylindrical connector devices to connect the foam cylinder together at its ends or to adjacent structures to form flotation devices, field markers, hoops, tunnels, wickets and other structures useful in sports and play.

7 Claims, 1 Drawing Sheet

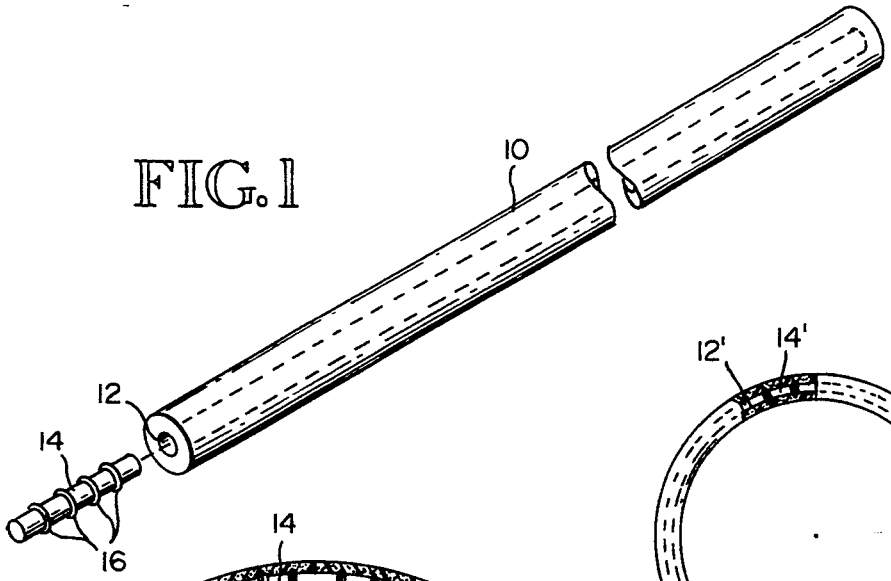
FIG. 1
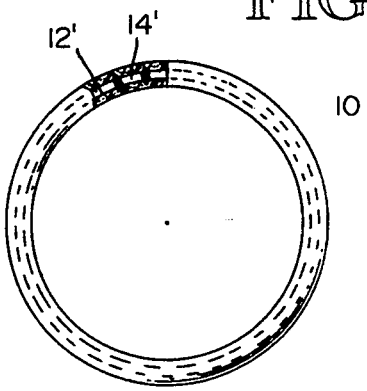
FIG. 2
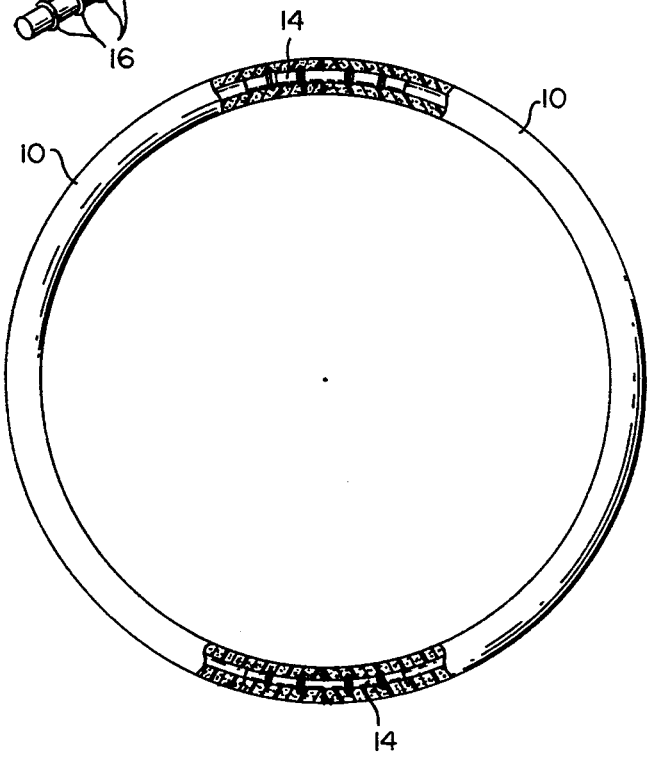
FIG. 3
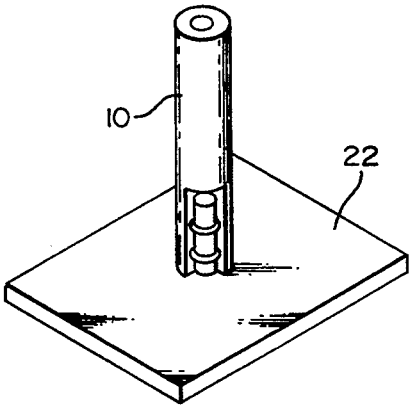
FIG. 5
FIG. 4
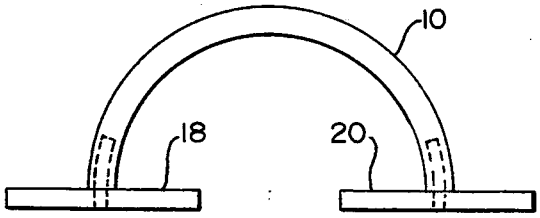

VERSATILE PLAYGROUND AND FLOTATION DEVICE

This is a continuation of copending application Ser. No. 07/747,600 filed on Aug. 20, 1991, now abandoned.

BACKGROUND OF THE INVENTION

1. Field of the Invention

This invention relates to a play field and amusement device for use by adults or children which may be modified and configured into a number of different shapes useful in various sporting and play activities. Devices of this nature desirably have a resilient construction so that the likelihood of injury to the user is minimized. Prior devices have been configured with a resilient outer surface and a rigid or semi-rigid interior core to provide sufficient strength for the foam material so that it may have reasonable durability and useful life. The device also must have convenient means for engagement with adjacent structures so that versatility of the device is maximized.

2. Description of Related art

Consideration has been given before to designing devices which are soft and may therefore be used in combative type play. Some specific examples in the prior art include the "Nerf" ball, a large pillow soft club like cylindrical device with a molded handle area and padded handguard, a cylindrical foam bat having a relatively rigid core designed to be gripped with both hands marketed under the ComBat tradename, soft foam dueling swords known as Boffer swords and the like. It is also known to provide an elongated tagging device designed to permit body contact without injury and which provides a loud popping sound when hit against a relatively solid target. This device, described in U.S. Pat. No. 4,690,404 has an elongated cylindrical shape and is constructed of polyethylene foam. The device is shaped with surface irregularities to provide the popping sound. No provision is made for axially connecting this device to an adjacent structure, nor to connect the device at its ends to form a ring.

Torroidal buoyancy aids are shown in U.S. Pat. No. 4,936,804. Articles of reinforced foam material are shown in U.S. Pat. 2,994,327. A game bat is shown in U.S. Pat. No. 3,921,978. A composite boundary marker having a foam structure attached to a flexible support member, which in turn may be attached to a road surface.

A foam bat useful as a toy in mock combat and psychological play therapy is shown in U.S. Pat. No. 4,079,936 which has the desirable features of a solid but resilient shaped foam structure. This device can be used for aggressive play and roughhousing by children without the likelihood of injury to the combatants. This device is a single purpose bat which has no provision for manipulation into various shapes and functions.

Another single purpose foam shape useful as an athletic field marker is shown in U.S. Pat. No. 3,371,647. This device uses a solid resilient foam post attached to a base which in turn may be attached to or inserted into a playing surface or turf area to define the boundary of a playing field. This device, while providing a means to anchor the field marker into the turf at a desired location, does not provide any means to attach itself to an adjacent structure to form a composite device.

While these known devices each have desirable attributes, they are not suitable nor modifiable into a multipurpose playground and flotation device which has many more uses than heretofore contemplated.

SUMMARY OF THE INVENTION

Devices for use in athletic events and play activities are constructed of elongated foam cylinders at least the end portions thereof being axially hollow to receive elongated connectors for engaging the elongated cylindrical foam structure to adjacent structures. The cylindrical connector, or connectors, which may be rigid or resilient, are adapted to slide axially within the end of the foam cylinder and to securely connect the foam cylinder to an adjacent structure. Contemplated structures include hoops and rings in which the ends of one or more foam cylinders are interengaged using the elongated cylindrical axially positioned fasteners. For this application a single foam cylinder may be formed into a circle and connected to itself or there may be a plurality of foam cylinders used wherein end portions of adjacent cylinders butt axially, utilizing the cylindrical connectors with the resulting elongated composite foam cylinder then being formed into a hoop or a ring utilizing an additional axially positioned connector. By utilizing various support structures such as ground or floor engaging pads and the like, resilient play and sports structures such as hurdles, tunnels, batting tees, field markers and the like can be constructed utilizing the concepts of this invention. The elongated foam cylinder itself may be used as a safe bat or sword for use in mock battle and martial arts training.

BRIEF DESCRIPTION OF THE DRAWINGS

The foregoing and other objects and advantages of the invention will be appreciated more fully from the following complete description thereof, with reference to the accompanying drawings wherein:

FIG. 1 is a perspective view of the cylindrical foam element of this invention with a connector means shown adjacent the end thereof;

FIG. 2 is a ring formed from the apparatus of FIG. 1.

FIG. 3 is a double ring or hoop formed from interengagement of two of the devices shown in FIG. 1.

FIG. 4 is a side elevational view of a low hurdle or tunnel configuration of the device.

FIG. 5 is a perspective view of a field marker or batting tee formed using the apparatus shown in FIG. 1 in conjunction with a base.

DESCRIPTION OF THE PREFERRED EMBODIMENT

Referring particularly to the drawings, wherein like figures indicate like parts, there is seen in FIG. 1 an elongated foam cylinder, (10) having an axially position bore, (12) extending throughout its length. An elongated cylindrical connector (14) is shown positioned for insertion with the bore (12) for secure engagement therewith. If desired, ridges (16) or other removable resistant means may be utilized to maintain connector 14 within the bore (12) of cylindrical foam element 10. Cylindrical element 10 is of a suitable diameter and length for the intended purpose. For example, for forming into a ring for use in a swimming pool as a float. The device would be of approximately three to five feet in length and have an outside diameter of two to four inches. Foam cylinder 10 may be advantageously formed with the axial bore extending only partway into the interior thereof, a distance sufficient to receive connector 14, but not extending throughout the length of cylinder 10.

In FIG. 2, the configuration of the device shown in FIG. 1 formed into a ring is shown, with a flexible cylindrical connector shown utilized in bore 12'. By Joining the opposite ends of a single, cylindrical element 10, a ring of relatively small diameter may be formed, which is most suitable for purposes such as flotation aid in swimming, for training in aquatics and other water sports, and similar water-related activities. Such rings also find use in sporting activities in which the ring is tossed for engagement with a goal member, or the myriad of other games children may create.

In FIG. 3, a larger diameter hoop is shown constructed of two cylindrical foam elements 10 engaged axially with connectors 14. Such structures may be used as targets for throwing games, larger float elements for water sports, and the like.

In FIG. 4, a structure utilizing the foam cylinder of figure one is shown, in which an arch shape is achieved by attaching each end of cylinder 10 to a ground or floor engaging base 18 or 20. In this configuration, the connector means 14 is securely fastened into base elements 18 and 20, and extends upward vertically therefrom. The cylindrical foam element 10 then has the connector element 14 thrust axially therein from each base and the foam element bent into the arc as shown. In configurations in which the connector element 14 is flexible, it will readily bend with the foam element 10 as shown. In configurations in which a relatively rigid connector piece (14) is utilized, the hoop formed by element 10 in FIG. 4 will have a higher arch, and can be suitable for games and physical activities in which a higher arch is required.

In FIG. 5, a configuration much like FIG. 4 is shown, but having only one ground or floor engaging pad 22. The foam cylinder 10 thus extends vertically and can be utilized as a goal or out-of-bounds marker for soccer games, football games, and other sporting activities. When severed at the right height, the device shown may suitably be used as a tee for tee-ball practice, and the like.

The foam cylinder 10 is advantageously formed of a resilient, but relatively rigid foam structure, which will maintain its shape, yet permit bending into various configurations. The foam material should be resistant to abrasion and impact and be resistant to damage from hard use on the play field or in the pool. The ground or floor engaging pads shown in FIGS. 4 and 5, preferably are of a relatively heavy foam construction, resilient to receive blows without damage to sporting participants, yet heavy and dense enough to maintain the hurdle or tunnel, batting tee or field marker in place during the event with which the device is utilized.

In compliance with the statute, the invention has been described in language more or less specific as too structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

We claim as our invention:

1. An arch shaped play field and amusement device comprising support pads and a resilient elongated, semi-rigid foam cylinder formed into a U shape having a connector receiving, axially positioned recess therein to receive connectors for engagement with said support pads, said supports pads each having an aperture to receive connectors therein, whereby said foam cylinder extends upwardly from said support pads; and connectors adapted to be inserted within said axial recess for connection of said foam cylinder to said support pads.

2. The apparatus of claim 1 wherein said connectors are resilient.

3. The apparatus of claim 1 wherein said connector have circumferential ridges thereon to prevent inadvertent removal of said connector from said axial recess.

4. The apparatus of claim 1 wherein said axial recess extends along substantially the entire length of said foam cylinder.

5. A safe field goal, batting tee, or sideline marker for use with field or gymnasium games comprising:

a flat resilient, ground or floor engaging support pad having a centrally located aperture;

a flexible connector inserted into said aperture and extending upwardly from said support pad;

a resilient foam cylinder extending upwardly from said resilient pad, said cylinder having a central axis and an axial aperture extending at least part way along said axis of said cylinder, said cylinder receiving said connector axially therein a distance adequate to firmly interengage said support pad and said cylinder, whereby a field goal, batting tee, or sideline marker is formed with said resilient foam cylinder extending vertically from said pad and providing a resilient structure to minimize potential of injury to participants.

6. The apparatus of claim 5 wherein said connector has circumferential ridges thereon to prevent inadvertent removal of said connector from said axial recess.

7. The apparatus of claim 5 wherein said axial recess extends along substantially the entire length of said foam cylinder.

* * * * *